United States Patent [19]

Sanders

[11] Patent Number: 4,979,080

[45] Date of Patent: Dec. 18, 1990

[54] FLASHING LIGHT APPARATUS DESIGNED FOR NEWSPAPER VENDING MACHINES

[76] Inventor: Ruth H. Sanders, P.O. Box 1073, Novato, Calif. 94945

[21] Appl. No.: 395,885

[22] Filed: Aug. 18, 1989

[51] Int. Cl.[5] ..... F21V 33/00

[52] U.S. Cl. ..... 362/154; 362/190; 221/8

[58] Field of Search ..... 221/8, 6, 5, 2; 312/223; 362/89, 98, 125, 127, 132, 154, 155, 190, 191, 253; 116/202; 340/815.15, 815.17, 815.16

[56] References Cited

U.S. PATENT DOCUMENTS 2,423,265 7/1947 Stewart ..... 221/8

4,047,150 9/1977 Kelly ..... 362/191

*Primary Examiner*—Ira S. Lazarus

*Assistant Examiner*—Sue Hagarman

*Attorney, Agent, or Firm*—Ruth H. Sanders

[57] ABSTRACT

The flashing light apparatus is an improved technique of advertising and of gaining the public's attention for the purpose of increasing the sale of newpapers. The flashing light is a single or dual light mounted on the front of a venting machine where it will easily catch the eye of the passing public. A timer push button switch is mounted on the inner partition wall, just inside the door, for easy access and activation of the light. Once the timer switch is manually activated, the light/lights will flash two and one half (2½) hours to alert the public that the late edition of the newspaper has arrived. The source of power for operation of the flashing light apparatus is a 6 volt lattern battery and is enclosed in a metal or plastic container which is mounted on the inside left wall as depicted in FIG. 1. The electrical circuit can be installed aft of the flashing light or it may be placed in the battery container. A placard is located on the inside bottom left corner of the door window, adjacent to the flashing light. The placard reads "Light Flashes for 2½ Hours After Each Delivery of Latest News."

5 Claims, 2 Drawing Sheets

FLASHING LIGHT APPARATUS DESIGNED FOR NEWSPAPER VENDING MACHINES

BACKGROUND-FIELD OF INVENTION

This invention relates to Newspaper Vending Machines, specifically to such machines which accommodate advertising and vending techniques to enhance the sale of newpapers.

BACKGROUND-DESCRIPTION OF PRIOR ART

A preliminary search was accomplished at the Patent Information Clearinghouse, Sunnyvale, California. Upon completion of the search, it was found that prior art directly germane to this invention was non-existent.

The contemporary newpaper vending machine of today not only dispenses newspapers through the use of a coin-operated machanism, but also accommodates advertising for the express purpose of increasing newspaper sales through the use of decals and placards installed at various points of the newsstand. In many instances, it is not uncommon to observe a vending machine with advertising overkill (numerous decals and placards). Such advertising displays tend to nullify the effectiveness of its overall purpose.

A flashing light apparatus designed to accommodate a newpaper vending machine provides a unique method of advertising and of gaining the public's attention. Once the light has attracted attention, a placard, located nearby, explains that the lastest edition of the news is "hot off the press" and available at this newsstand.

OBJECTS AND ADVANTAGES

Several objects and advantages of the present invention are:

(a) to provide a flashing light apparatus that is simple to use and inexpensive to manufacture.

(b) to provide a flashing light apparatus that is easily maintained—cost effective.

(c) to provide a flashing light apparatus where the user has the option of installing a single or dual lamp.

(d) to provide a flashing light apparatus that may use a red or blue light lense or any other colored lense that may be selected by the user.

Still further objects and advantages will become apparent from a consideration of the ensuring description and drawings.

DRAWING FIGURES

The drawings applicable to this invention are as follows:

FIG. 1 shows the flashing light apparatus of the Newspaper Vending Machine.

FIG. 2 shows the battery container and cover.

FIG. 3 shows the electrical schematic for the flashing light.

FIG. 4 shows the single lamp lense and circuit housing arrangement.

FIG. 5 shows the front view of the dual lamp lense and circuit housing arrangement.

FIG. 6 shows the side view of the dual lamp lense and circuit housing arrangement.

BRIEF DESCRIPTION OF THE DRAWING

A typical embodiment of the flashing light apparatus of the present invention is illustrated in FIG. 1. A sketch of a vending machine shows approximate location points of the flashing light apparatus components.

DESCRIPTION OF THE PREFERRED EMBODIMENT(S)

The flashing light apparatus is placed into operation upon delivery of the newspaper. Upon placing papers inside the newwsstand, the operator can depress a push-button switch to activate the timer and flashing light. The light will flash for two and one-half ($2\frac{1}{2}$) hours at which time it will automatically turn-off. The flashing light and timer is manually activated upon each delivery of the news.

Figure 1:
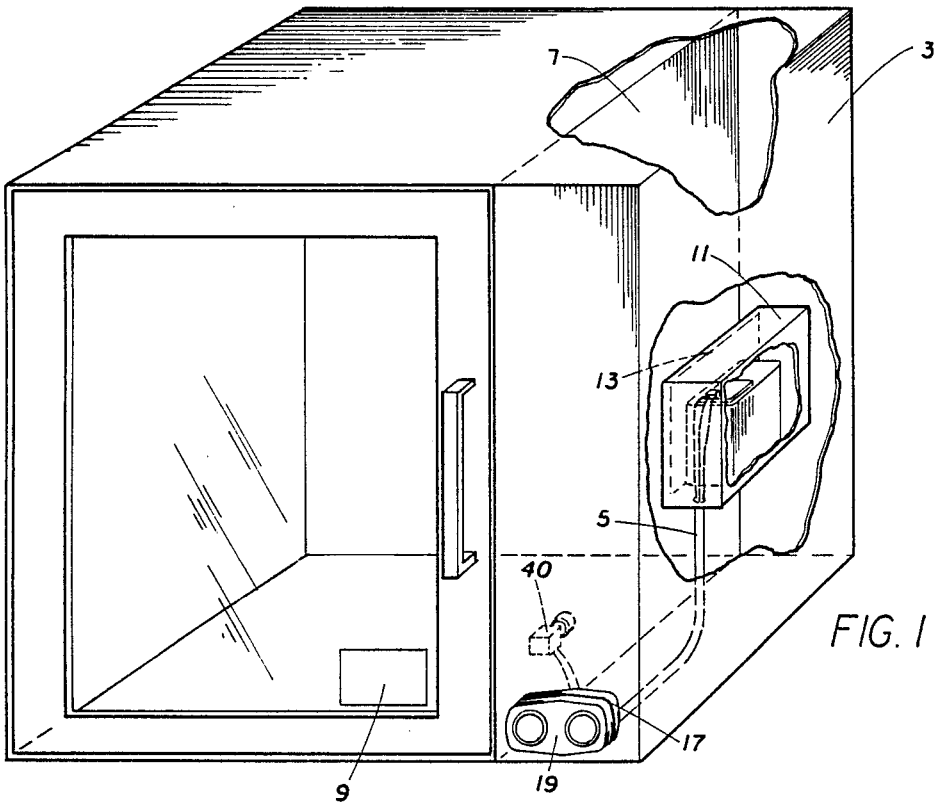
Figure 2:
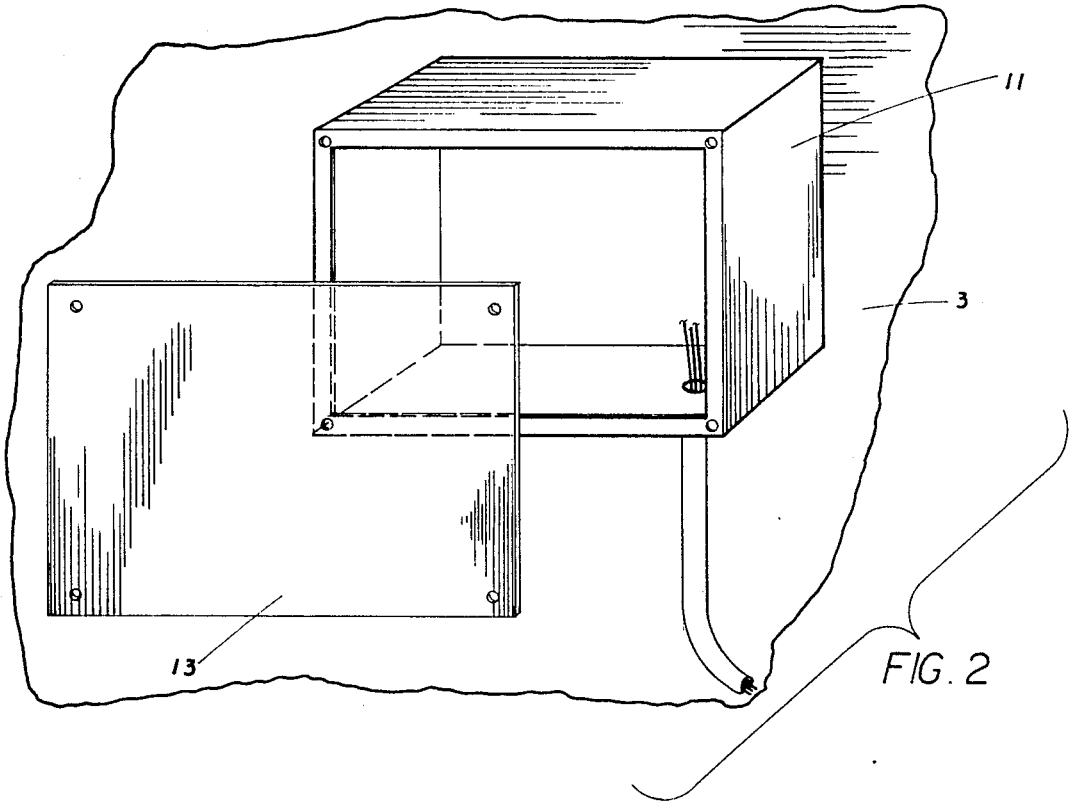
FIG. 2 is a battery container with cover. The container is made of metal or of strong plastic material.
Figure 3:
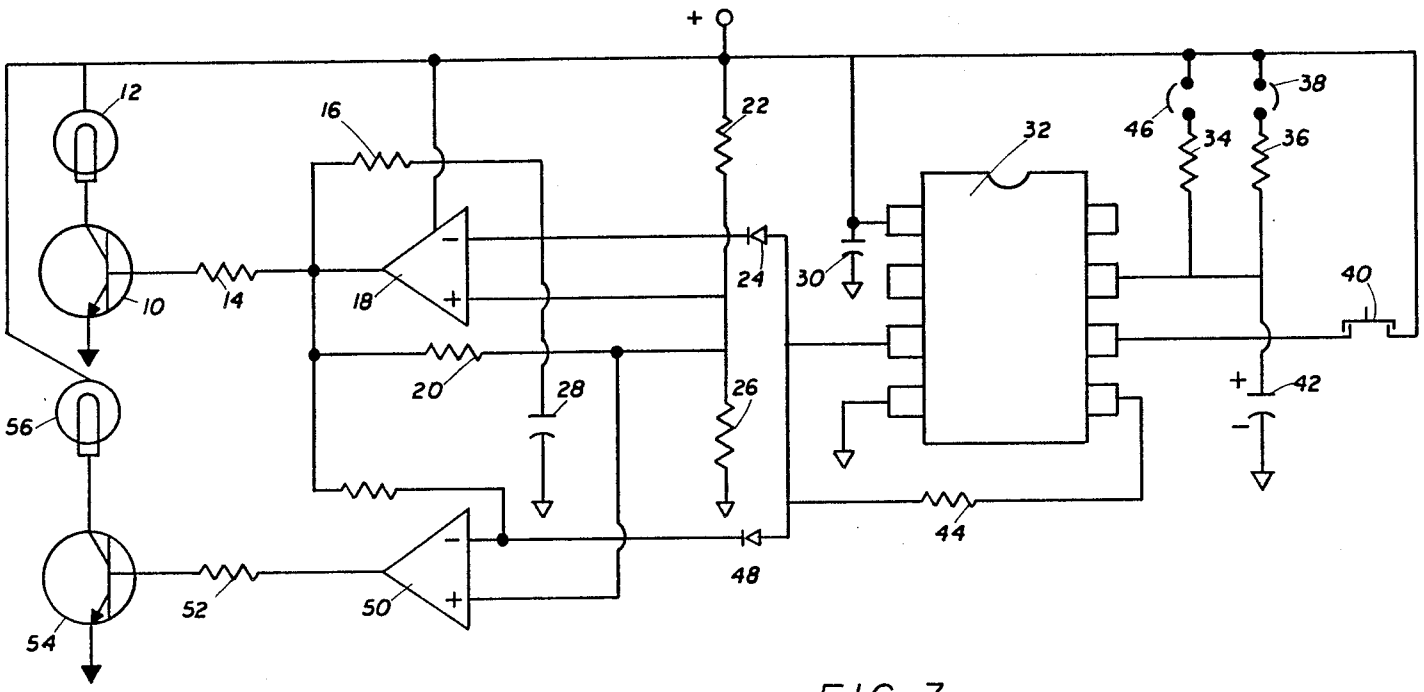
FIG. 3 is a schematic of the electrical circuit. The duration selector switches (38 and 46) determines the operation frequency of the oscillator/timer (32) and thus the length of time it allows a lamp to flash. The push button switch (40), when depressed, activates the oscillator/timer (32) to operate for a selected duration of time. The fixed low frequency lamp flasher (18) and inverter (50) operate the lamp drivers (10 and 54) to power the lamps (12 and 56) which are enabled by the oscillator/timer (32).
Figure 6:
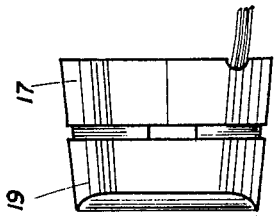
FIGS. 4, 5, and 6 show a single lamp lense (15) and a dual lamp lense (19) each with a circuit housing (17) attached. The electrical connections (5) from the battery to the electrical circuit and push button switch (40) are as shown in FIG. 1. A 6 volt battery (latern type) is used as the source of power.
Figure 5:
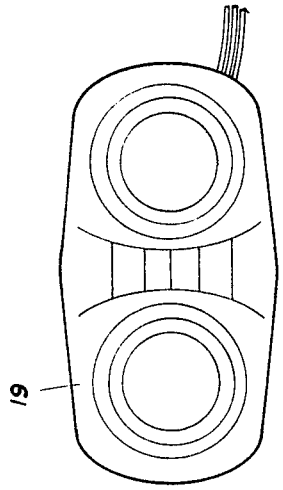
Figure 4:
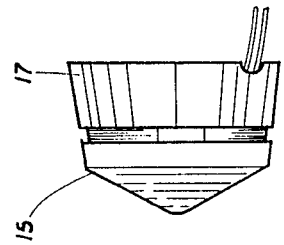

FIG. 3 shows the electrical schematic of the flashing light apparatus. Reference numerals are used in the schematic to identify the electrical components.

REFERENCE NUMERALS IN DRAWING—FIG. 3

10 Transistor 3700 (lamp driver)
12 6 V Lamp
14 1K Resistor
16 3.3M Resistor
18 NE532 OP Amp (low frequency lamp flasher)
20 100K Resistor
22 100K Resistor
24 1N458 Diode
26 100K Resistor 28 1 MF Capacitor
30 1 MF Capacitor
32 XR-2243 Timer (oscillator/timer)
34 56.2K Resistor
36 107K Resistor
38 Jumper No. 2
40 Push button
42 100 MF Capacitor
44 51K Resistor
46 Jumper No. 1
48 1N458 Diode
50 NE532 OP Amp (inverter)
52 3.3M Resistor
54 Transistor 3700 (lamp driver)
56 6 V Lamp

SUMMARY OF THE INVENTION

Accordingly, the reader will see that the flashing light apparatus when used on newspaper vending machines is an attention-getting device. Once attention has been gained, the public will note the placard (9) adjacent to the flashing light which explains that the light flasher for a period of time after the latest edition of the news has arrived. The flashing light apparatus has the additional advantages in that it provides a means of advertising considered to be unique for newspaper vending machines.

it provides a means of increasing the sale of newspapers.

Three newspaper vending machines equipped with flashing lights were placed in various locations over a six-month period. The records maintained over this period indicate a fifteen percent increase in newspaper sales.

I claim:

1. A flashing light for a newspaper vending machine comprising:

a flashing light enclosed within a colored, plastic light housing attached to an inner wall of said newpaper vending machine;

a circuit board, containing a timer for activating said flashing light for a predetermined time period, electrically connected to said flashing light;

a battery, contained in a battery housing, electrically connected to said circuit board for providing power to said flashing light, and;

a push button switch for activating said timer, thereby activating the flashing light so as to alert prospective buyers to the presence of newspapers in the newspaper vending machine.

2. The flashing light of claim 1 wherein the light is a single or dual 6 volt lamp.

3. The flashing light of claim 1 wherein said light housing is either colored red or blue.

4. The flashing light of claim 1 wherein said battery is a 6 volt latern battery.

5. The flashing light of claim 1 wherein said battery housing is made either of metal or strong plastic.

* * * * *